US006224174B1

(12) United States Patent
Mu

(10) Patent No.: US 6,224,174 B1
(45) **Date of Patent: *May 1, 2001**

(54) POSTER DISPLAY APPARATUS

(76) Inventor: Joseph W. Mu, 4611 Jamaica, Sugar Land, TX (US) 77479

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/208,160

(22) Filed: Dec. 9, 1998

(51) Int. Cl.[7] ..... A47B 63/00
(52) U.S. Cl. ..... 312/183; 40/373
(58) Field of Search ..... 312/183, 190, 312/193; 40/371, 373, 388; 211/50, 45, 47, 169

(56) References Cited

U.S. PATENT DOCUMENTS

| | | | | |
|---|---|---|---|---|
| 1,273,894 | * | 7/1918 | Madison | 211/184 X |
| 1,463,950 | | 8/1923 | Goldberger . | |
| 2,523,347 | | 9/1950 | Weston . | |
| 3,224,824 | | 12/1965 | Remke . | |
| 3,583,570 | * | 6/1971 | Black | 211/45 |
| 3,625,368 | * | 12/1971 | Toms | 40/388 X |
| 3,817,393 | * | 6/1974 | Neilsen | 211/50 |
| 4,164,309 | * | 8/1979 | Staats | 312/193 X |
| 4,193,652 | | 3/1980 | Brown, Jr. . | |
| 4,266,834 | * | 5/1981 | Ackeret | 312/183 X |
| 4,312,548 | * | 1/1982 | Posso | 312/183 X |
| 4,949,484 | * | 8/1990 | Finger | 312/183 X |
| 5,067,780 | * | 11/1991 | Rickard | 312/193 |
| 5,127,340 | * | 7/1992 | Maro et al. | 211/187 X |
| 5,346,298 | * | 9/1994 | Headley | 312/190 X |

FOREIGN PATENT DOCUMENTS

| | | | | |
|---|---|---|---|---|
| 103345 | * | 12/1941 | (SE) | 312/193 |

* cited by examiner

*Primary Examiner*—Peter M. Cuomo
*Assistant Examiner*—Hanh V. Tran

(57) ABSTRACT

A poster display apparatus provides a slanted back, a curved front, opposing sides, and a bottom that define an interior space. The apparatus holds posters therein in an upright display position. An antislip member of the apparatus reduces the relative movement of the posters to one another and to the apparatus. The front and back slant backward near the bottom portion of the posters causing the bottom portions of the posters to slant backward. The backward slant also reduces movement of the posters during browsing. One alternative includes an adjustable front and back to maintain the relative distance and force between the front and the posters, the back and the posters, and the posters themselves further reducing the slippage of the posters during browsing.

29 Claims, 5 Drawing Sheets

FIG. 9
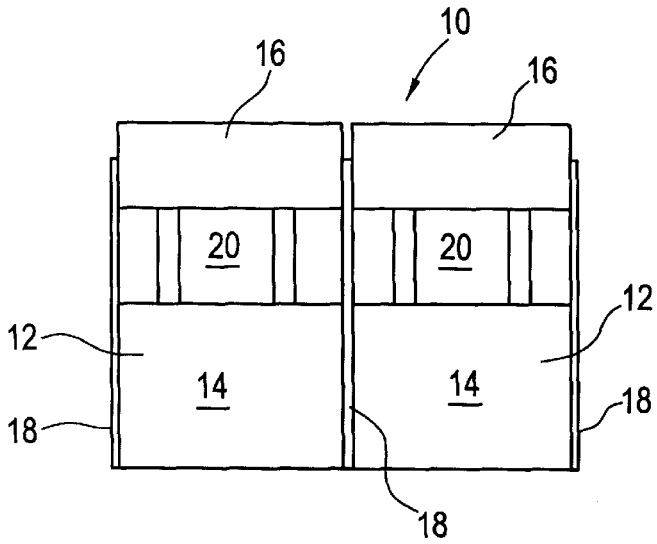
FIG. 10
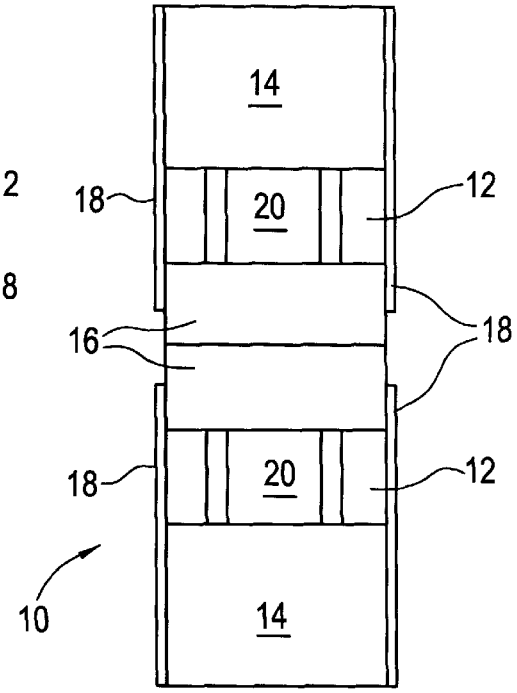
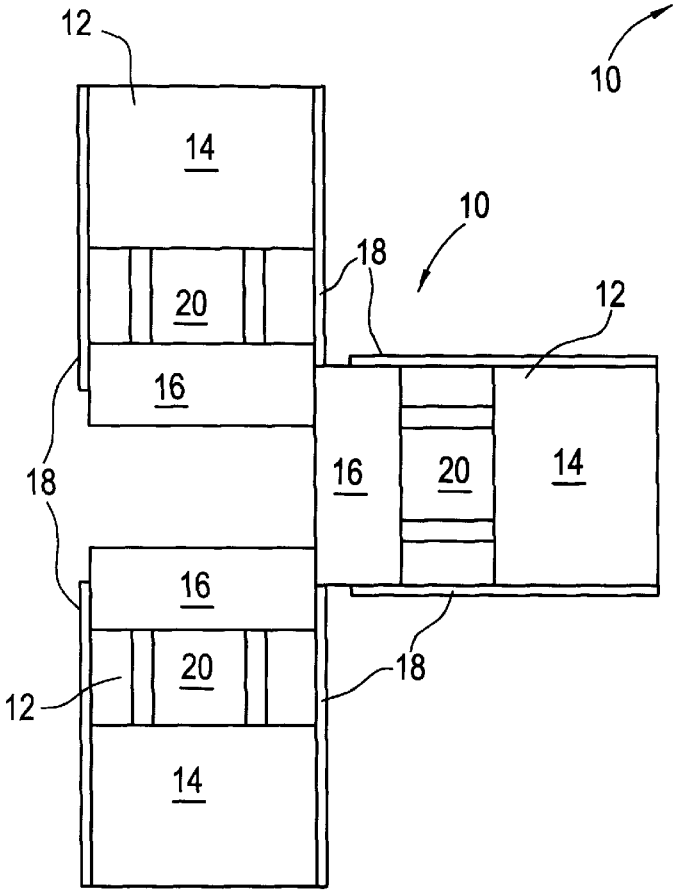
FIG. 11

POSTER DISPLAY APPARATUS

BACKGROUND OF THE INVENTION

1. Field of Invention

The present invention relates to the field of displays. More specifically, the invention relates to a device for displaying a plurality of posters in an upright display position that allows the user to easily view the posters, remove and replace the posters, and that reduces potential damage to the posters.

2. Related Art

Presently, when posters are sold, one manner in which they are typically displayed is by placing them in holders designed to hold two posters back to back and that are pivotally mounted at their back end to allow a potential purchaser to flip through the selections. These devices are relatively expensive and bulky limiting the selection of available posters. Further, use of the devices at conventions is impractical, difficult, and costly because transporting the bulky device requires a relatively large truck and reduces the space available for transporting product.

Another manner of displaying posters is to simply stack the posters on a table and allow the patrons to sort through the posters. However, this method is inconvenient and often results in damage to the posters and lost inventory.

Yet another method of displaying posters is to mount each of the posters to a piece of stiff cardboard, or other backing, designed to keep the poster straight and protected. The posters with the backing are then placed in a box-like structure with the posters and backing resting on a bottom edge. The potential purchaser may then flip through the available selections. Although this method of displaying posters is relatively space efficient, the backing does significantly increase the space required for the display and transport of the posters. Additionally, the cost of the backing material makes its use for less expensive posters impractical; and the labor required to attach each of the posters to the backing increases the cost of the posters and decreases the usefulness of the display method.

Displaying the posters vertically in a box-like structure without a backing material has been impractical to date primarily because the posters bend and their weight exerts a force against the bottoms of the posters pushing the bottoms together. Thus, the posters are difficult to pull from the display resulting tearing of the posters and the pulling of a plurality of posters (either fully or partially) from the device at one time. Further, replacement of the posters into the display is difficult, or impossible, due to the bunching of the poster bottoms. Accordingly, the posters pulled from such a display are often simply set aside resulting in a disorderly display area and damage to the posters. Therefore, displaying posters in this manner is not practical, effective, or cost efficient.

A seldom used technique for displaying posters is to simply mount the posters to the walls and provide the posters to the customer from inventory when purchased. However, this method requires substantial wall space, limits the available selection, and is impractical for conventions.

Thus, there remains a need for a cost effective, space efficient manner of displaying posters for sale.

SUMMARY OF THE INVENTION

To achieve such improvements, the present invention generally provides a poster display apparatus adapted to hold a plurality of posters in a substantially upright display position that reduces bunching of the bottom portions of the posters allowing a customer to easily browse through the posters, remove posters from the apparatus, and replace posters in the apparatus. The poster display apparatus also provides a lowered, preferably curved front that facilitates browsing of the posters and reduces damage to the posters. The posters are placed in the apparatus without backing material so that the device can easily hold a substantial number of posters without requiring substantial space.

One aspect of the present invention provides an apparatus for displaying posters that provides a body having a front, a back, opposing sides, and a bottom, the body defining an interior space and an upper opening. The body is adapted to hold and display a plurality of posters in a substantially upright display position.

Preferably, the front of the body is adapted to maintain a bottom portion of the plurality of posters at an angle to the bottom of the body. The angle between the abutment surface and the bottom of the body is preferably less than about ninety degrees, but in an alternative embodiment is approximately equal to about ninety degrees. Thus, the abutment surface is adapted to maintain a bottom portion of the plurality of posters proximal the bottom of the body at a nonperpendicular angle to the bottom of the body with the bottom portion slanting toward the back of the body.

Additionally, the front of the body defines a curved abutment surface having a bottom end proximal the bottom of the body and an opposite apogee end that is convex with respect to the interior space and that is adapted to support the plurality of posters in a forward position. The length of the abutment surface is approximately equal to the height of the plurality of posters. The apogee end of the abutment surface, in alternative embodiments, curves downward or is at least about horizontal. A portion of the abutment surface intermediate the apogee end and the bottom end is preferably about horizontal to maintain the posters in a forward position.

Preferably the abutment surface provides a nonslip coating adapted to reduce the slippage between the abutment surface and the plurality of posters. In one embodiment, the nonslip coating is rubber.

In another preferred embodiment, the back of the body is adapted to maintain a bottom portion of the plurality of posters at an angle to the bottom of the body. Typically, the back of the body and the bottom of the body form an angle that is greater than about ninety degrees. In alternative embodiments the back of the body is substantially flat or arcuate. In the curved back embodiment, the back of the body is preferably convex with respect to the interior space.

Preferably, the apparatus also provides an antislip member attached to the body that is adapted to reduce the relative motion of the plurality of posters to one another and to the body. The antislip member is attached to the bottom and/or the sides of the body. Therefore, in one embodiment, the bottom of the body has an upper surface adapted to provide increased friction between the upper surface and a bottom of the plurality of posters. This increased friction is accomplished using grooved defined by the upper surface, a roughened upper surface, or an antislip member such as, inter alia, sandpaper, rubber, or a mild adhesive.

An alternative embodiment employs opposing sides of the body that each have an inner surface adapted to provide increased friction between the inner surface and opposing sides of the posters. For example, the sides may have a brush attached to the inner surface of each of the opposing sides of the body with the brushes adapted to provide increased friction between the inner surface and the opposing sides of the plurality of posters. In another embodiment, the sides have springs attached thereto that are adapted to bias at least a portion of the opposing sides inward against the opposing sides of the plurality of posters.

Yet another embodiment of the present invention provides a body that is adapted to maintain a predetermined relative distance between the front of the body and the plurality of posters, the back of the body and the plurality of posters, and the plurality of posters themselves. Thus, the body is adapted to maintain a predetermined force between the plurality of posters, the front, and the back. Accordingly, to provide the desired adjustability, the front of the body is adjustably positionable and/or the back of the body is adjustably positionable. In alternative embodiments, the front of the body is adapted to move vertically, to selectively rotate about a pivot point, and to move forward and rearward. Likewise, in alternative embodiments, the back of the body is adapted to selectively rotate about a pivot point and to move forward and rearward.

To reduce the potential of damage to the posters, the opposing sides of the body preferably each define an upper edge with the upper edge having a chamfer on an inner portion thereof.

So that the apparatus may be easily transported, the opposing sides preferably define handles therethrough.

Another aspect of the invention provides a plurality of interconnected bodies that each are adapted to hold and display a plurality of posters in a substantially upright display position. The bodies may be connected side by side, back to back, or at adjacent rear corners of the bodies.

Another alternative embodiment of the present invention provides a body that has a front section, including the front of the body, and a back section, including the back of the body. The front section and the back section are removably attachable to one another. A storage wall is removably attachable to the back section, extends between the opposing sides, and is spaced from the back of the body. The storage wall, the opposing sides, and the back define a back section interior space adapted to maintain a plurality of posters therein.

Yet another aspect of the present invention provides an apparatus for displaying posters that provides means for holding and displaying a plurality of posters in a substantially upright display position and means for maintaining the relative position of the plurality of posters to facilitate removal and replacement of individual posters. Preferably the invention provides means for maintaining a bottom portion of the plurality of posters at a nonperpendicular angle slanted toward a back of the means for holding, means for reducing the slippage between the plurality of posters and the means for holding, and means for maintaining the relative force between the plurality of posters, a front of the means for holding, and a back for the means for holding.

BRIEF DESCRIPTION OF THE DRAWINGS

The manner in which these objectives and other desirable characteristics can be obtained is explained in the following description and attached drawings in which:

FIG. 9 is a top view of an alternative embodiment of the present invention providing two bodies attached side by side.

FIG. 10 is a top view of an alternative embodiment of the present invention providing two bodies attached back to back.

FIG. 11 is a top view of an alternative embodiment of the present invention providing three bodies attached near their rear corners.

Figure 1:
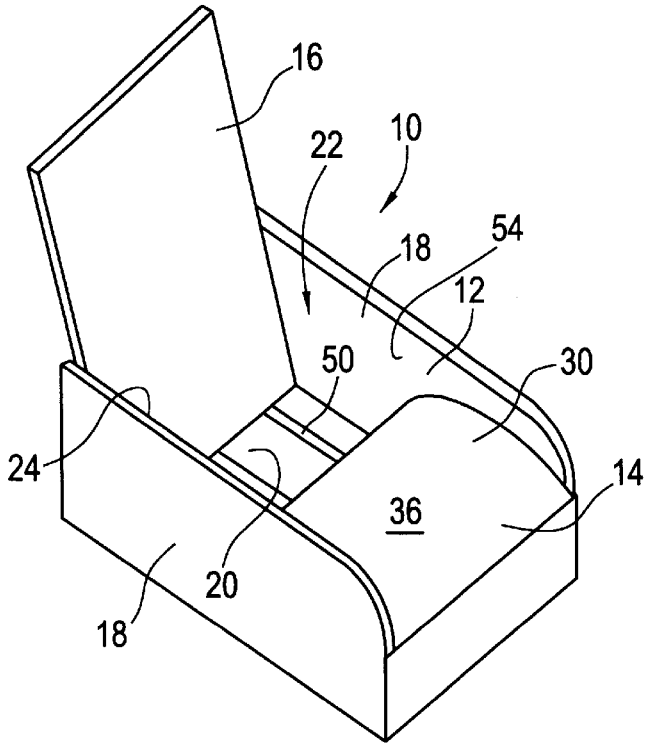
FIG. 1 is an isometric view of an embodiment of the present invention.
Figure 2:
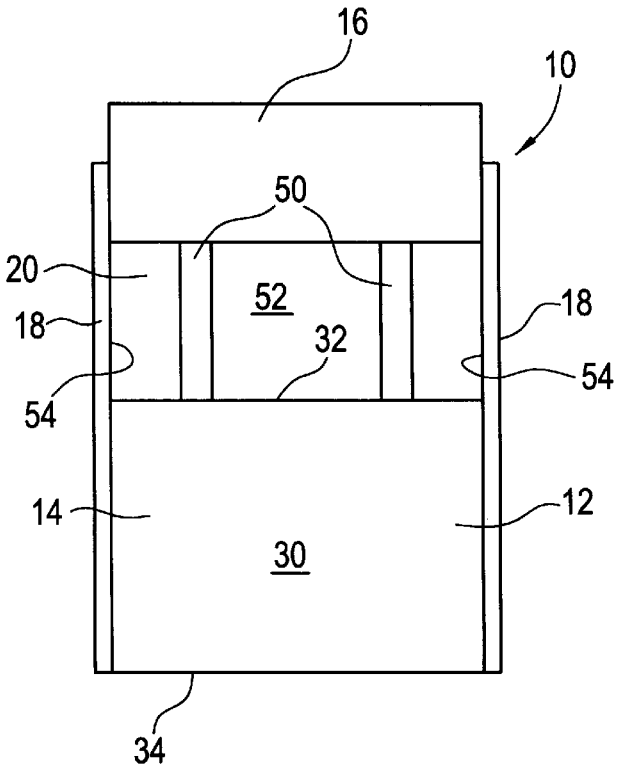
FIG. 2 is a top elevational view of an embodiment of the present invention.
Figure 3:
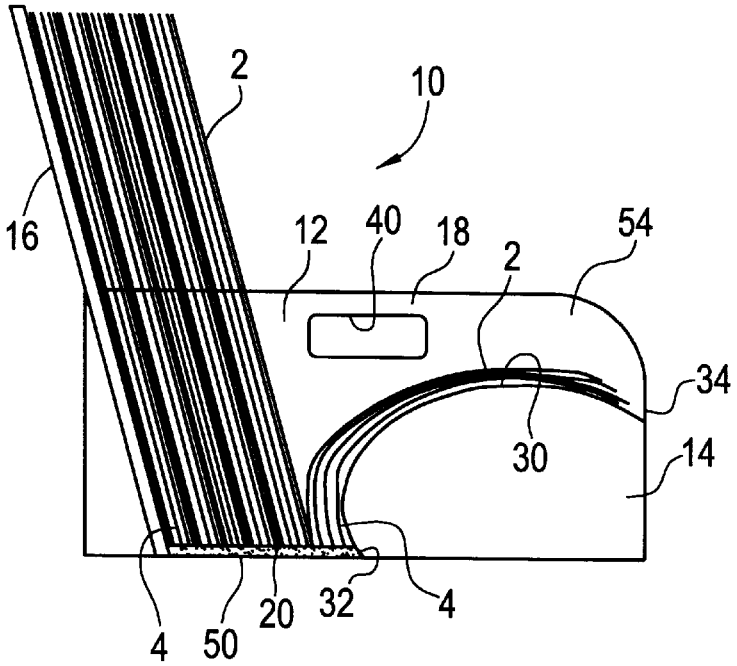
FIG. 3 is a side elevational, partial cross sectional view of an embodiment of the present invention.
Figure 4:
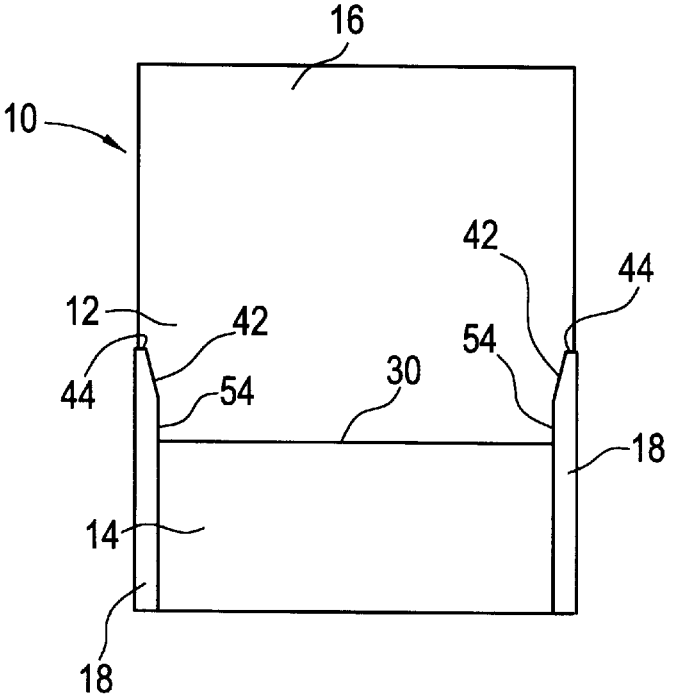
FIG. 4 is a front elevational view of an embodiment of the present invention.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention generally provides a poster display apparatus adapted to hold a plurality of posters in a substantially upright display position that reduces bunching of the bottom portions of the posters allowing a customer to easily browse through the posters, remove posters from the apparatus, and replace posters in the apparatus. The poster display apparatus also provides a lowered, preferably curved front that facilitates browsing of the posters and reduces damage to the posters. The posters are placed in the apparatus without backing material so that the device can easily hold a substantial number of posters without requiring substantial space.

FIGS. 1 through 4 are isometric, top, side, and front views respectively of one embodiment of the present invention. In general, the poster display apparatus 10 provides a body 12 that has a front 14, a back 16, opposing sides 18, and a bottom 20. The body 12 defines an interior space 22 between the front 14, back 16, sides 18, and bottom 20 and an upper opening 24. The body 12 is adapted to hold and display a plurality of posters 2 in a substantially upright position.

Posters 2 are substantially flat, thin, and flexible having opposing display surfaces and a periphery, or edge. As used herein, the "upright display position" shall mean that the poster 2 rests on an edge of the poster 2 extending generally upward therefrom. Preferably, in such a position, the display surface(s) containing the product indicia thereon are facing in a direction that is convenient for the customer to view. Also, preferably, the plurality of posters 2 are oriented with the display surface(s) containing the product indicia thereon facing in the same direction and with the display surfaces of adjacent posters 2 abutting one another (i.e. with no backing or other material interposed therebetween; although such material may be placed therein, the posters 2 may be placed in individual wrappings, protective material may be placed therebetween, and other similar modifications may be made without departing from the scope of the present invention). Accordingly, in the preferred embodiment, the posters 2 are "stacked" and positioned on their bottom edges, in the upright display position, within the interior space 22 of the body 12.

The body 12 is sized according to the size of the posters 2 to be held therein. The height of the back 16 is preferably at least as high as the height of the posters 2.

However, the front 14 of the body 12 does not typically extend upward the full height of the posters 2 so that the customer may easily browse through the posters 2 flipping them to a forward position in which they bend over the front 14. Although the front 14 may be a relatively thin, flat member or have a squared comer, the front 14 preferably has an abutment surface 30 facing the interior space 22 of the body 12 that is curved. The curved abutment surface 30 reduces the damage to the posters 2 when they are placed in the forward position by eliminating comers and the like. The curve of the abutment surface 30 is preferably convex with respect to the interior space 22 to accommodate the natural bend of the posters 2 as they are placed in the forward position. To maintain the posters 2 in the interior space 22, however, the front 14 presents at least a portion thereof that extends upward. The front 14 then curves forward and curves to a horizontal or downward orientation (in alternative embodiments) near its apogee end 34 (the end of the front 14 opposite the bottom end 32 which is proximal the bottom 20 of the body 12) to facilitate browsing of the posters 2. Providing at least a portion of the abutment surface 30 of the front 14 in a horizontal orientation helps to maintain the posters 2 in the forward position. Preferably, the length of the abutment surface 30 is at least as long as the height of the posters 2 in order to support the full length of the posters 2 in the forward position. In one alternative embodiment, the abutment surface 30 of the front 14 provides a nonslip coating 36, such as rubber or other material, that is adapted to reduce the slippage between the abutment surface 30 and the plurality of posters 2.

The sides 18 preferably define an aperture therethrough that serves as a handle 40. The handle 40 is sized to accommodate a person's hand and is positioned relatively near the top to facilitate stable and convenient carrying. Also, an upper edge 44 of the upper surface 52 includes a chamfer 42 on an inner portion thereof. The chamfer 42 eliminates the sharp corners of the upper edge 44 and helps to reduce any damage to the posters 2 as they are removed and replaced in the apparatus 10.

As stated previously, displaying a plurality of posters 2 in the manner of the present invention has, in the past, been deemed ineffective due to the flexible nature of the posters 2 that allows the posters 2 to bend which exerts a force, from the weight of the posters 2, on the bottom of the posters 2 causing the posters 2 to "bunch" at the bottoms and exert lateral forces between the posters 2. Bunching of the posters 2 is exacerbated when a customer browses through the plurality of posters 2. During browsing, the customer flips the posters 2, in turn, to a forward position in which at least an upper portions of the posters 2 are bent forward to reveal the poster 2 immediately behind the posters 2 in the forward position. The bottoms of those posters 2 in the forward position tend to slide back 16 due to the natural resiliency of the posters 2, thus exerting additional lateral bunching forces on the bottom portions 4 of the posters 2. The resulting lateral forces, or bunching, make removal and replacement of the posters 2 difficult. The present invention addresses these problems using three basic approaches which may be used individually or in combination. In general, these three components/approaches of the apparatus 10 that eliminate bunching are (1) maintaining a bottom portion 4 of the posters 2 at an angle, (2) increasing the friction between the body 12 and the posters 2 to reduce slippage or movement (bunching) of the posters 2, and (3) maintaining a relatively constant distance between the front 14 and the posters 2, the back 16 and the posters 2, and the posters 2 themselves.

Accordingly, the front 14 and/or the back 16 of the body 12 is adapted to maintain a bottom portion 4 of the posters 2 at an angle to the bottom of the body 12 so that at least the bottom portion 4 of the poster 2 slants toward the back 16 of the body 12. Such a slant, or angle, is effective at reducing bunching because, as the customer browses through the posters 2 flipping the posters 2 to the forward position, the weight of the posters 2 tends to resist the backward motion of the bottom portions 4 of the posters 2 because of their angled orientation. The weight of the poster 2 tends to force the angled bottom forward, toward the front 14 of the body 12; whereas moving the upper portion of the poster 2 forward tends to force the bottom backward. Therefore, the forces counteract one another reducing slippage, movement, and bunching.

The front 14 of the body 12 has a bottom end 32 proximal the bottom 20 of the body 12 and an opposite apogee end 34. To facilitate the angled orientation of the bottom portion 4 of the posters 2, at least the portion of the front 14 of the body 12 proximal the bottom end 32 of the front 14 is angled with respect to the bottom 20 of the body 12 at an angle of less than ninety degrees (i.e. the front 14 and the bottom 20 form a nonperpendicular angle) with the bottom portion of the front 14 slanting upward toward the back 16 of the body 12. Therefore, the bottoms of the posters 2 placed in the interior space 22 tend to move somewhat toward the front 14 due to their flexibility and the bottom portions 4 of the posters 2 tend to also slant toward the back 16 of the body 12 at an angle to the bottom 20. Thus, the angled bottom portion of the front 14 maintains an angled bottom portion 4 of the posters 2 which reduces slippage and bunching. Note that the front 14 may be pivotally mounted to the sides 18 to allow for adjustment of the relative angle of the front 14 to the bottom 20.

The back 16 of the body 12 is preferably attached to the body 12 at an angle to the bottom 20 to provide the desired angle of the bottom portion 4 of the posters 2. Thus, the back 16 and bottom preferably form a nonperpendicular angle therebetween that is greater that ninety degrees when measured from the interior space 22. Therefore, the back 16 preferably slants backward. With a back 16 that is slanted, the front 14 and bottom 20 may intersect at a substantially ninety degree angle although this is not necessarily preferred.

In one embodiment, the back 16 of the body 12 is substantially flat. However, in an alternative embodiment, the back 16 is arcuate and has a convex curve with respect to the interior space 22. One advantage of the arcuate back 16 is that it may help to correct any bends formed in the posters 2 created as a result of their remaining bent in the forward position for an extended period of time.

Figure 5:
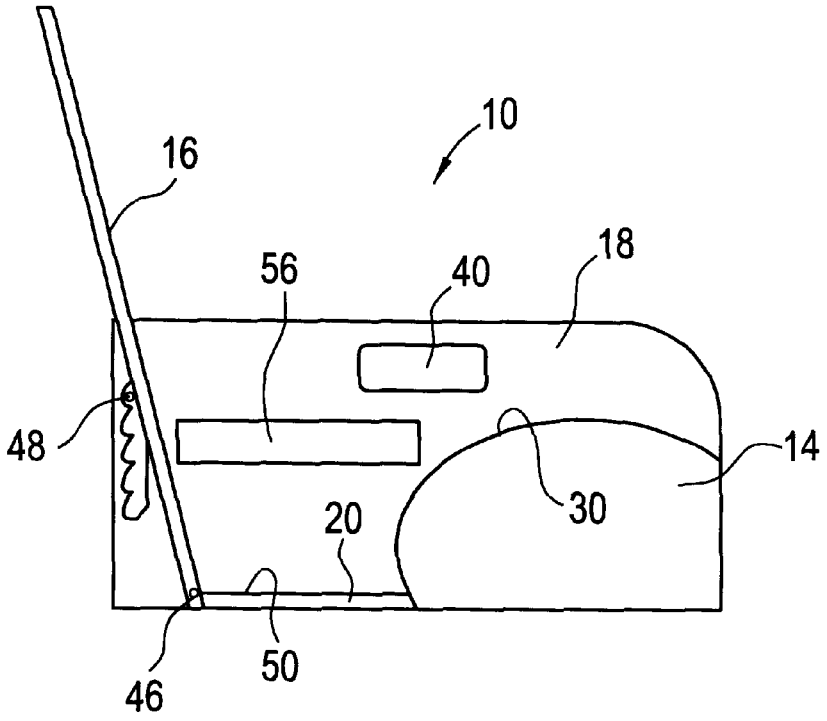
FIG. 5 is a side elevational, partial cross sectional view of an embodiment of the present invention.

Also, the angle of the back 16 may be adjustable. FIG. 5 is a side elevational, partial cross sectional view of a body 12 having a back 16 that may be adjusted. The bottom of the back 16 is pivotally attached to the sides 18 of the body 12 so that the back 16 is free to rotate about the pivotal attachment. A movable back support 48 fits within a slot 64 in each of the sides 18 of the body 12; the slot 64 defines a plurality of back support positions. By moving the back support 48 to the different positions, the angle of the back 16 to the bottom 20 changes. Note that the embodiment shown is but one possible embodiment among many and any embodiment that provides for the adjustment of the angle of the back 16 to the body 12 is acceptable.

Another manner of reducing bunching is to increase the friction between the body 12 and the posters 2. Accordingly, the preferred embodiment of the present invention provides an antislip member 50 attached to the body 12 that is adapted to reduce the relative motion of the posters 2 to one another and to the body 12. The antislip member 50 may be attached to the bottom 20 or to the sides 18 of the body 12. In one embodiment, the bottom 20 has an upper surface 52 that is adapted to provide increased friction between the upper surface 52 of the bottom 20 and the posters 2. Increasing the friction may be accomplished in a variety of ways such as by providing lateral grooves in the upper surface 52, roughening the upper surface 52, or attaching an antislip member 50 to the upper surface 52 of the bottom 20. Examples of suitable antislip members 50 include, inter alia, sandpaper, rubber, a mild adhesive, a soft plastic, a short brush, or other similar materials.

Figure 6:
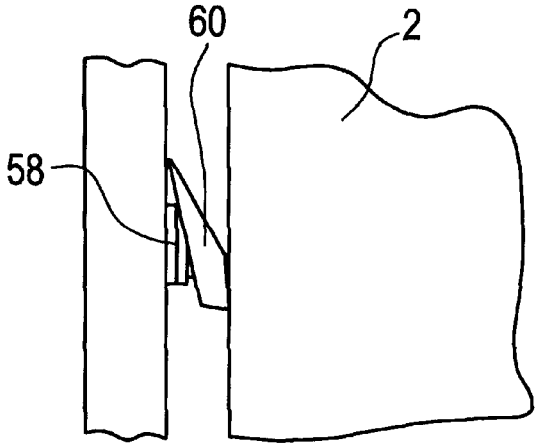
FIG. 6 is a partial elevational view showing one embodiment of an antislip member attached to the side of the body.

In an alternative embodiment, shown in FIG. 5, the opposing sides 18 of the body 12 have an inner surface 54 that is adapted to increase the friction between the inner surface 54 and the opposing sides 18 of the posters 2. This may be accomplished by attaching an antislip member 50, such as brushes 56 or other materials, to the inner surfaces 54. FIG. 6 shows another alternative embodiment for increasing the friction between the inner surfaces 54 and the sides 18 of the posters 2 provides springs 58 attached to the opposing sides 18 of the body 12 that are adapted to bias at least a portion of the opposing sides 18 inward against the opposing sides 18 of the posters 2. One end of the compression spring 58 is attached to an inner surface 54 of the side of the body 12 and the opposite end of the spring 58 is attached to a side abutment 60. The spring 58 pushes the side abutment 60 against the side of the posters 2 increasing the frictional force therebetween.

Figure 7:
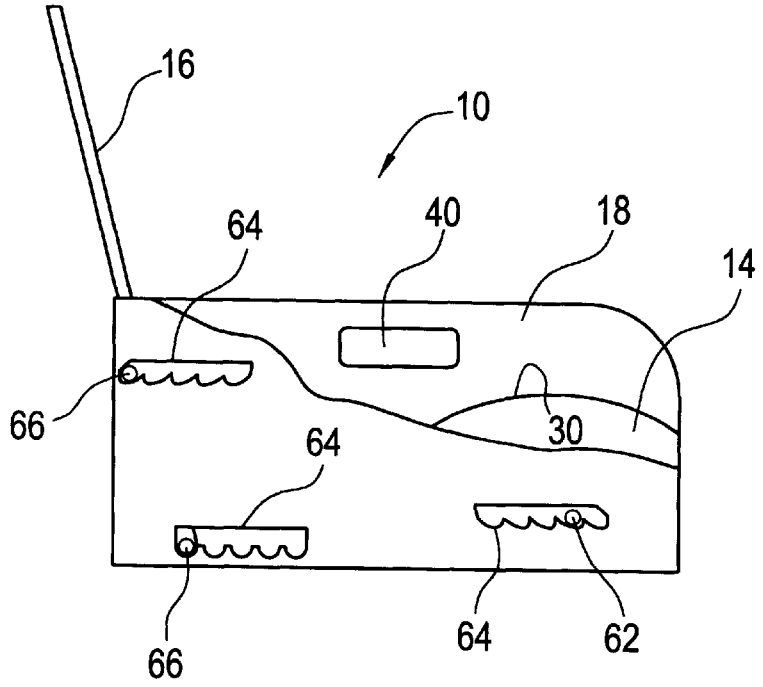
FIG. 7 is a side elevational, partial cross sectional view of an alternative embodiment of the present invention.

The third primary manner of reducing bunching of the posters 2 is maintaining a relatively constant distance between the front 14 and the posters 2, the back 16 and the posters 2, and the posters 2 themselves. Thus, in one embodiment, shown in FIG. 7, the body 12 is adapted to maintain these relative distances and the relative forces therebetween. To maintain the relative distances, the front 14 or back 16 may be adjustably positioned. For example, in one embodiment, the front 14 attaches to the sides 18 using an attachment pin 62 on each side that rides in a slot 64 formed in each of the sides 18. The slots 64 define a plurality of front 14 positions between which the front 14 may be moved. The adjustment pins 66 and slots 64 may be used to provide for adjustment of the front 14 in a front-to-back, vertical, or other direction (although the figure shows a front-to-back arrangement). Note that many other embodiments may be used to provide for the adjustable positioning of the front 14.

A similar system is employed in one embodiment of an adjustable back 16. In this embodiment, the pivot pin attached to the bottom 20 of the back 16 extends through slots 64 in the side of the body 12. Likewise, adjustment pins 66 attached to the back 16 at a position offset from the body 12 extend through a second set of slots 64 defined by the sides 18 of the body 12. The slots 64 each define a plurality of positions for the respective pins. Moving the pins between the positions defined by the slots 64 allows for the selective positioning of the back 16 as well as the adjustment of the angle formed between the back 16 and the bottom 20. The pin and slot 64 arrangement may be used to adjust the front-to-back as well as the vertical positioning of the back 16.

Figure 8:
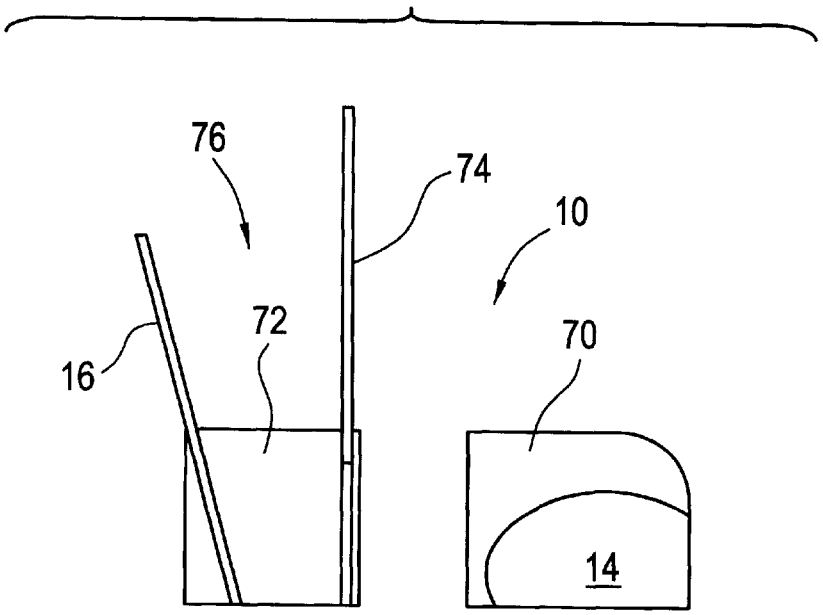
FIG. 8 is a side elevational, partial cross sectional view of an alternative embodiment of the present invention.

FIG. 8 is a side elevational view of one alternative embodiment of the present invention. In this embodiment, the body 12 is formed of a front section 70, which includes the front 14 of the body 12, and a back section 72, which includes a back 16 of the body 12. The front section 70 and the back section 72 are removable attachable to one another such as by hooks, screws, clamps, or the like. A removable storage wall 74 is provided. The storage wall 74 is selectively attachable to the back section 72 of the body 12 at an end of the back section 72 opposite the back 16. Thus, the storage wall 74, which extends between the sides 18 of the body 12, along with the back 16, the sides 18, and the bottom of the back section 72, define a back section interior space 76 adapted to maintain a plurality of posters 2 therein. As the curved front 14 may occupy about two-thirds of the total length, or depth, of the body 12, separating the two sections enhances the portability of the device. Also, the back section 72 may be used to store and ship posters 2 therein. Then, when the apparatus 10 requires refilling, the back sections 72 of the body 12 may simply be replaced (i.e. the empty back section 72 removed and the full back section attached). Thus, the removable back section 72 including the storage wall 74 facilitates shipping and provides interchangeability. Note that the front section 70 is also relative expensive in relation to the back section 72 due to the curved upper surface 52 of the front 14.

FIGS. 9 through 11 shows alternative embodiments of the invention that provide a plurality of interconnected bodies. As shown in the figures, the bodies may be attached to one another side-to-side, back-to-back, or adjacent their rear corners, respectively. In such arrangements, the bodies may share common sides 18, backs 16, and the like.

Note that the bodies may have legs attached thereto, may rest on a table or the floor, or may provide other support members or methods.

While the foregoing is directed to the preferred embodiment of the present invention, other and further embodiments of the invention may be devised without departing from the basic scope thereof, and the scope thereof is determined by the claims which follow.

I claim:

1. An apparatus for displaying posters, comprising:

a body having a front, a back, opposing sides, and a bottom, the body defining an interior space and an upper opening;

the body is adapted to hold and display a plurality of posters in a substantially upright display position;

the front of the body defines a curved abutment surface having a bottom end proximal the bottom of the body and an opposite apogee end, the abutment surface is adapted to maintain a bottom portion of the plurality of posters proximal the bottom of the body at a nonperpendicular angle to the bottom of the body with the bottom portion slanting toward the back of the body, an antislip member attached to the body, the antislip member adapted to reduce the relative motion of the plurality of posters to one another and to the body, the bottom of the body having an upper surface adapted to provide increased friction between the upper surface and a bottom of the plurality of posters; and, the abutment surface is further adapted to maintain the plurality of posters proximal the opposite apogee end of the abutment surface substantially horizontal and slanting toward the front of the body.

2. The apparatus of claim 1, wherein the abutment surface is convex with respect to the interior space.

3. The apparatus of claim 1, wherein the abutment surface and the bottom of the body form an angle of about ninety degrees.

4. The apparatus of claim 1, wherein the abutment surface and the bottom of the body form an angle of less than ninety degrees.

5. The apparatus of claim 1, wherein the length of the abutment surface is approximately equal to the height of the plurality of posters.

6. The apparatus of claim 1, wherein the abutment surface further comprises a nonslip coating adapted to reduce the slippage between the abutment surface and the plurality of posters.

7. The apparatus of claim 6, the nonslip coating is rubber.

8. The apparatus of claim 1, wherein the back of the body is adapted to maintain a bottom portion of the plurality of posters at an angle to the bottom of the body.

9. The apparatus of claim 1, wherein the back of the body and the bottom of the body form an angle that is greater than ninety degrees.

10. The apparatus of claim 1, wherein the back of the body is substantially flat.

11. The apparatus of claim 1, wherein the upper surface is roughened.

12. The apparatus of claim 1, wherein said antislip member is attached to the bottom of the body, the antislip member adapted to reduce the relative motion of the plurality of posters to one another and to the bottom of the body.

13. The apparatus of claim 12, wherein the antislip member comprises sandpaper attached to the upper surface of the bottom of the body.

14. The apparatus of claim 12, wherein the antislip member comprises rubber attached to the upper surface of the bottom of the body.

15. The apparatus of claim 12, wherein the antislip member comprises a mild adhesive attached to the upper surface of the bottom of the body.

16. The apparatus of claim 1, further comprising the opposing sides of the body each having an inner surface adapted to provide increased friction between the inner surface and opposing sides of the plurality of posters.

17. The apparatus of claim 16, further comprising a brush attached to the inner surface of each of the opposing sides of the body, the brushes adapted to provide increased friction between the inner surface and the opposing sides of the plurality of posters.

18. The apparatus of claim 16, further comprising springs attached to the opposing sides of the body, the springs adapted to bias at least a portion of the opposing sides inward against the opposing sides of the plurality of posters.

19. The apparatus of claim 1, wherein the body is adapted to maintain a predetermined relative distance between the front of the body and the plurality of posters, the back of the body and the plurality of posters, and the plurality of posters themselves.

20. The apparatus of claim 1, further comprising the body is adapted to maintain a predetermined force between the plurality of posters, the front, and the back.

21. The apparatus of claim 1, wherein the front of the body is adjustably positionable.

22. The apparatus of claim 14, wherein the front of the body is adapted to move vertically.

23. The apparatus of claim 14, wherein the front of the body is adapted to selectively rotate about a pivot point.

24. The apparatus of claim 1, wherein the back of the body is adjustably positionable.

25. The apparatus of claim 14, wherein the back of the body is adapted to selectively rotate about a pivot point.

26. The apparatus of claim 1, wherein the opposing sides of the body each define an upper edge, the upper edge having a chamfer on an inner portion thereof.

27. The apparatus of claim 1, further comprising the opposing sides defining handles therethrough.

28. The apparatus of claim 1, further comprising:

the body having a front section, including the front of the body, and a back section, including the back of the body;

the front section and the back section removably attachable to one another.

29. The apparatus of claim 28, further comprising:

a storage wall removably attachable to the back section, the storage wall extending between the opposing sides and spaced from the back of the body;

the storage wall, the opposing sides, and the back defining a back section interior space adapted to maintain a plurality of posters therein.

* * * * *